United States Patent [19]

Bjor

[11] Patent Number: 4,542,794

[45] Date of Patent: Sep. 24, 1985

[54] METHOD AND A MEANS FOR ALIGNING A ROCK DRILL

[75] Inventor: Hakon E. Bjor, Hvalstad, Norway

[73] Assignee: Ingeniør Thor Furuholmen A/S, Oslo, Norway

[21] Appl. No.: 372,236

[22] Filed: Apr. 26, 1982

[30] Foreign Application Priority Data

Apr. 29, 1982 [NO] Norway ..... 811460

[51] Int. Cl.[4] ..... E21B 15/04

[52] U.S. Cl. ..... 173/1; 173/43; 901/41

[58] Field of Search ..... 173/43, 1, 39; 175/40; 408/13; 409/186-188, 193, 194; 364/559; 299/1, 10; 414/700, 730; 901/41

[56] References Cited

U.S. PATENT DOCUMENTS

| | | | |
|---|---|---|---|
| 3,470,969 | 10/1969 | Arcangeli | 173/43 |
| 4,190,117 | 2/1980 | MacLean | 173/43 |
| 4,267,892 | 5/1981 | Mayer | 173/43 |
| 4,288,056 | 9/1981 | Bergstrom | 173/43 |
| 4,410,049 | 10/1983 | Molin | 173/43 |

FOREIGN PATENT DOCUMENTS

| | | |
|---|---|---|
| 395743 | 8/1977 | Sweden . |
| 403814 | 9/1978 | Sweden . |
| 1157915 | 7/1969 | United Kingdom . |
| 1600659 | 10/1981 | United Kingdom . |

*Primary Examiner*—James M. Meister
*Assistant Examiner*—John L. Knoble
*Attorney, Agent, or Firm*—Wenderoth, Lind & Ponack

[57] ABSTRACT

The alignment of the drill stem and bit of a rock drill rig is corrected when the force of drilling and the feeding power on the drilling machine of the rig has resulted in a change in the direction of the drill stem because of deformation of the articulated and extensible drill boom of the rig and of its pivotally supported drill support on the drill boom. The drill rig is of the type that includes elements for measuring boom lengths and articulation angles, servos for controlling such lengths and angles and a control unit which is connected to the measuring elements and servos for adjusting the drill stem and bit. The various articulation angles which are required to compensate for deformations of the drill boom and drill support are determined as if the drill boom and support were in an unloaded condition, on the basis of measured values of the boom lengths and articulation angles which have been registered in the control unit in an unloaded condition. The adjusted articulation angles are corrected to the determined articulation angles when full feeding power is applied.

5 Claims, 3 Drawing Figures

METHOD AND A MEANS FOR ALIGNING A ROCK DRILL

BACKGROUND OF THE INVENTION

The present invention relates to a method and apparatus for aligning the drill stem and bit of a rock drill rig when the drilling procedure starts.

When drilling holes in a rock for blasting or other purposes it is important that each hole extends in a correct direction. However, the hole may be formed in a wrong direction even if the drill stem has been correctly adjusted and positioned before the drilling procedure starts. Such faulty drilling mainly has two causes. On one hand, this faulty drilling may happen because the drill stem and bit are pushed against the rock at such a high feeding power that the articulated and extensible drill boom, as well as the pivotally supported feed support of the rock drill rig, are bent or deformed with the resut that the drill stem and bit are caused to extend in a wrong direction. On the other hand, the drill bit may slip sideways along an uneven rock surface and thus bring the drill stem out of its correct direction. In addition to being aligned in an incorrect direction, the drill stem may in both cases be exposed to bending which will reduce its useful life.

Due to the practical geometry of the drill boom, a perfect correction of the direction of the drill stem and bit requires adjustment on preferably all axes of the boom. This correction conventionally is performed manually, and often is measured by sight. Possible instrumentation in this connection has hitherto been limited to a means that shows the direction of the feed support. Manual adjustment of the drill, with or without such a means, is a difficult operation and the result is to a great extent dependent on the ability and attention of the operator. When drilling peripheral holes in particular, high requirements are placed an the operator because the direction of the drill stem is then especially important, since these holes determine the shape of the cavity to be blasted.

When the drill stem has been formed in a wrong direction, the operator of today has to adjust the stem by sighting from the operator's seat on the drill rig. In many situations when drilling in tunnels, however, visual observation of the direction and of the bend of the drill stem is almost impossible because sighting is hindered by the drill boom and support.

SUMMARY OF THE INVENTION

When having a good procedure for setting of the drill against the rock surface, the number of events when the drill bit slips during setting, is considerably reduced. The object of the present invention is to provide a method and apparatus for effective correction of faults which are due to deformations of the drill boom and drill support because of the feeding power. A further object of the invention is to provide such a method and apparatus for achieving correction automatically.

The invention has a close relationship to an automatically controlled drill rig which comprises elements for measuring boom lengths and articulation angles, servo means for controlling such lengths and angles and a control unit which is connected to said measuring elements and said servo means for adjustment of the drill stem. The method according to the invention is characterized in that the various articulation angles which are required to compensate for deformation of the drill boom and feed support are determined as if these were in a loaded condition, on the basis of measured values of the boom lengths and articulation angles which have been registered in the control unit in an unloaded adjusted condition. Further, the adjusted articulation angles are corrected to the determined articulation angles when full feeding power is applied. Thus, the drill stem and bit are located at a correct position and direction in the loaded condition as well. The means for performing said method automatically includes a control unit comprising an electronic computer, preferably a microprocessor, and is characterized in that the computer includes a mathematical model, preferably a computer program, with a definition of the changes of the articulation angles.

The method and means defined above have in practice proved to result in precise corrections of fault directions which are due to deformations of the drill boom and the drill bit because of the feeding power on the drilling machine.

BRIEF DESCRIPTION OF THE DRAWINGS

The invention now will be described further, with respect to a preferred embodiment of the invention and with references to the enclosed drawings, wherein.

DETAILED DESCRIPTION OF THE INVENTION

Figures 1, 2:
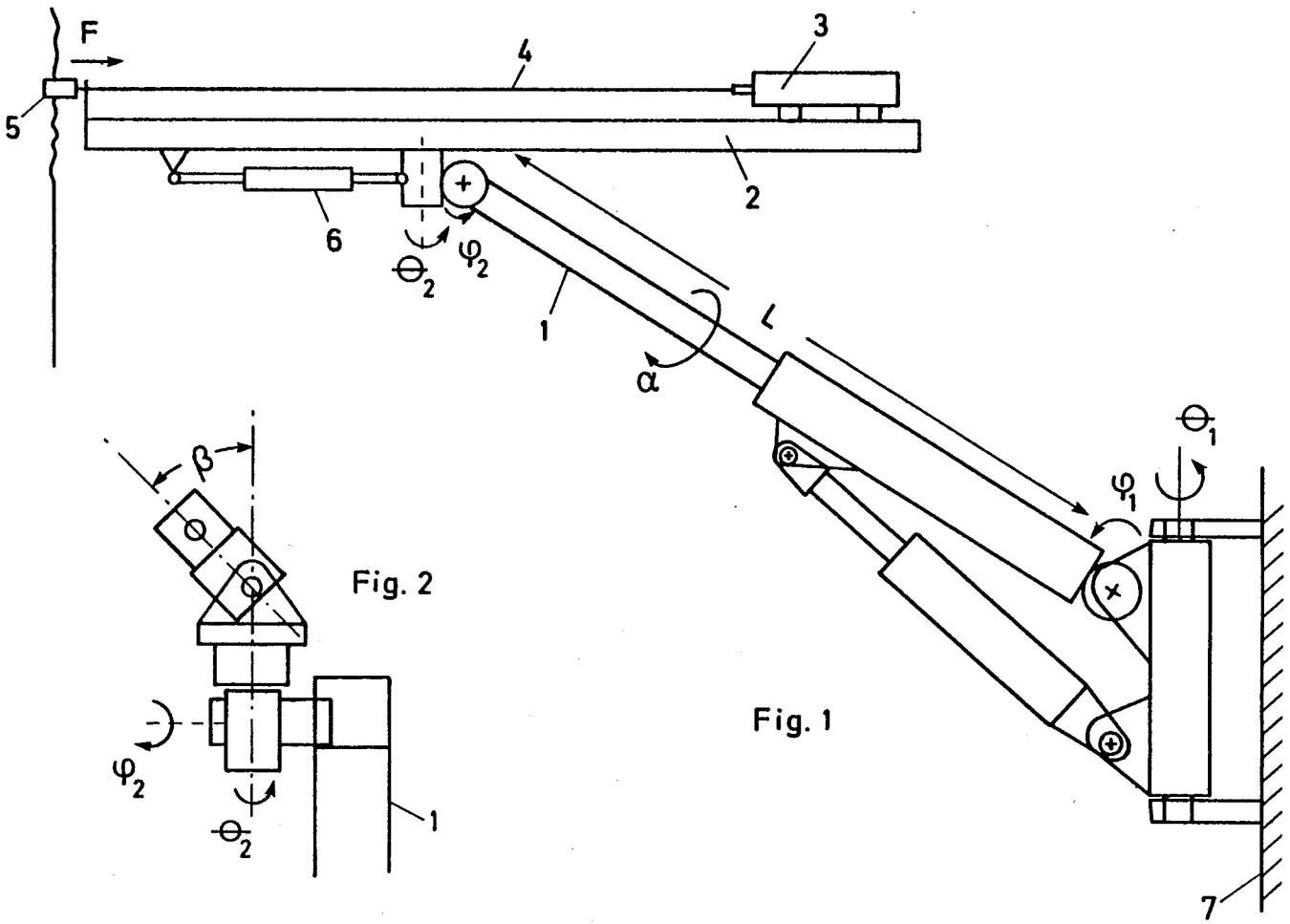
FIG. 1 is a schematic view of a drill boom and drill support with a drill stem and bit of a rock drill rig.
FIG. 2 is an enlarged schematic view of a detail of FIG. 1, viewed from the left side thereof.

In FIG. 1 is shown an articulated and extensible drill boom 1 which carries a pivotally supported drill support 2 with a drilling machine 3, drill stem 4 and bit 5. The drill support 2 is moved forward and backwards by means of a hydraulic cylinder 6. The drill boom 1 is fixed to a drill rig at a supporting location 7. The drill rig is of the type which is used for drilling and blasting tunnels in rocks.

The drill boom 1 can be turned horizontally an angle $\theta_1$, and vertically an angle $\Phi_1$. Additionally, the boom 1 may be rotated about its axis an angle $\alpha$ in relation to its rear end support 7 on the rig. The length L of the boom 1 can be adjusted, and such length can be measured by means of any suitable measuring element of a previously known type. Likewise, the drill support 2 can be rotated horizontally and vertically by the angles $\theta_2$ and $\Phi_2$ about two respective axes which extend orthogonally to each other. Additionally, the drill support 2 may be rotated an angle $\beta$ around an axis which is parallel to the support 2, as indicated in FIG. 2.

Figure 3:
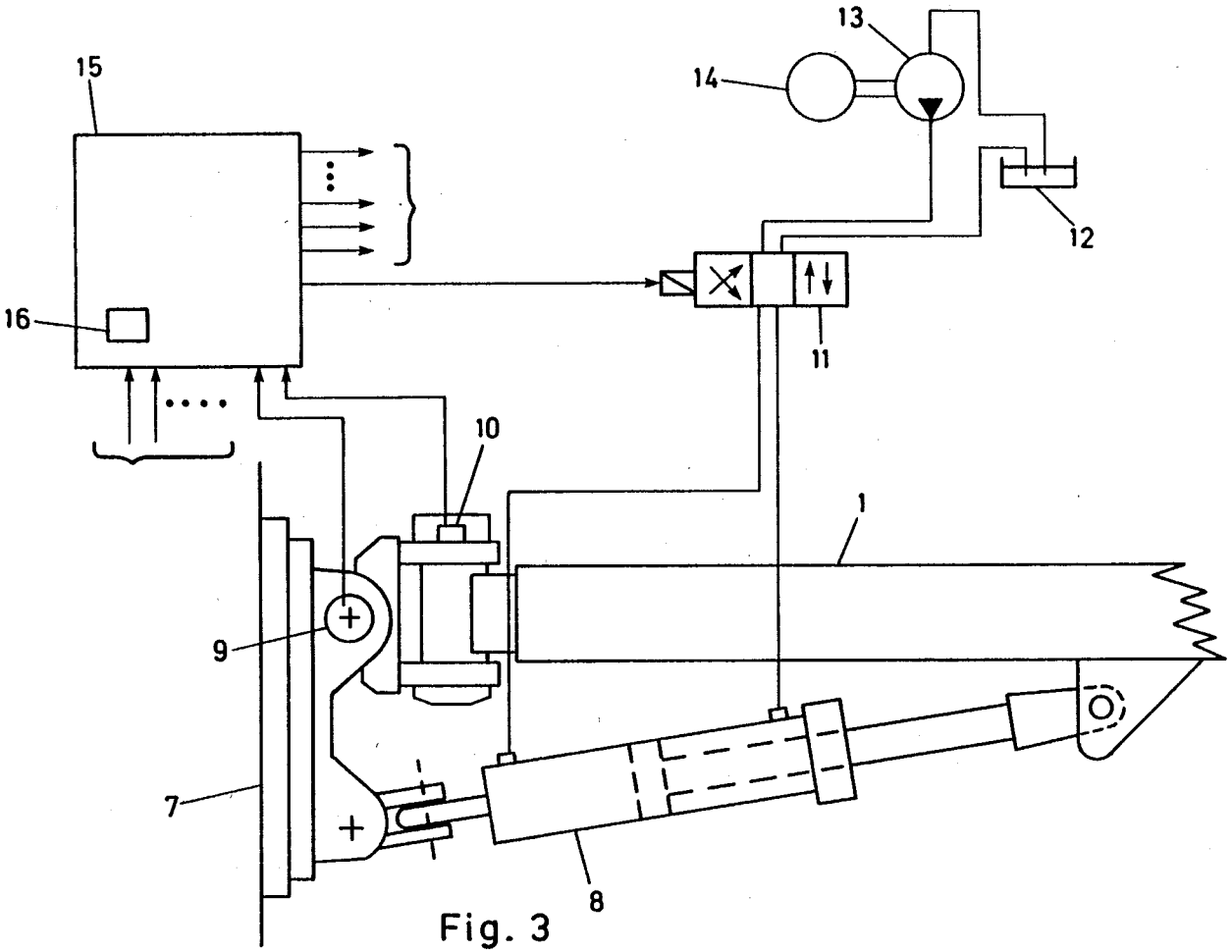
FIG. 3 is a schematic view of the drill boom in FIG. 1 coupled with a control system.

The drill boom 1 and drill support 2 are equipped with previously known elements for measuring boom lengths and articulation angles, and the rig comprises servo means for controlling such lengths and angles, as indicated in FIG. 3. Further, the rig is equipped with a control unit in a previously known manner, which unit is connected to the measuring elements and servo means for adjusting and feeding the drilling stem 4, and which can control a number of drill booms 1 and drill support 2.

In FIG. 3 is shown a portion of the drill boom 1 and its support 7. The boom 1 can be moved by means of a hydraulic cylinder 8 which also is shown in FIG. 1. In FIG. 3 is indicated an element 9 for the measurement of the angle $\Phi_1$, and an element 10 for the measurement of the angle $\Phi_1$. Corresponding elements for measuring the remaining angles are omitted for the sake of clarity of the drawings. For the sake of simplicity only one servo means is shown, namely a servo valve 11 for adjusting among other values, the angle $\Phi_1$ by means of the hydraulic cylinder 8. The servo valve 11 is connected to an oil tank 12 and a hydraulic pump 13 driven by a motor 14.

Electrical signals from at least the angle sensors or elements 9 and 10 reach an electronic control unit 15 as indicated with arrows and spots. From the control unit 15 electrical signals are supplied to among other means, the servo valve 11 as indicated. All measuring elements and servo means are connected to the control unit 15 which may be in the form of one or more microprocessors.

When the drill bit 5 is pushed against the rock with a feeding power F on the drill stem 4, the drill support 2 is subjected to a bending moment resulting from the force from the rock acting on drill stem 4 and the force from the cylinder 6. This bend or deformation of the drill support 2 will occur in a plane through the drill stem 4 and cylinder 6. This deformation may be compensated for by correcting the angles $\Phi_2$ and $\theta_2$ as follows:

$$\Delta\Phi_{21}=K_3\cdot F\cdot\cos\beta$$

$$\Delta\theta_{21}=K_3\cdot F\cdot\sin\beta$$

wherein $K_3$ is an experimentally adapted rigidity constant for the boom 2. For the feeding power F a measured or assumed typical value may be used.

Additionally, the supplied feeding power will cause a bending or deformation of the drill boom 1 which is proportional to the feeding power F and the projection of the boom 1 in a plane which extends at a right angle to the drill stem 4. The deformation of the boom 1 may be compensated for in the following two manners:

(1) $\Phi_1$ and $\theta_1$ are corrected or changed such that the axes of the angles $\Phi_2$ and $\theta_2$ are located in the same positions in space after the boom 1 was bent, as they were before the boom was bent, thus:

$$\Delta\Phi_1=K_1\cdot L\cdot F\cdot(\sin\Phi_2\cdot\cos\alpha+\sin\theta_2\cdot\sin\alpha)$$

$$\Delta\theta_1=K_1\cdot L\cdot F\cdot(\sin\theta_2\cdot\cos\alpha+\sin\Phi_2\cdot\sin\alpha)$$

wherein $K_1$ is an experimentally adapted rigidity constant for the boom 1.

(2) $\Phi_2$ and $\theta_2$ are corrected or changed such that the direction of the drill support 2 becomes the same even if the front or outermost end of the boom 1 has changed direction because of the deformation, thus:

$$\Delta\Phi_{22}=K_2\cdot L\cdot F\cdot\sin\Phi_2$$

$$\Delta\theta_{22}=K_2\cdot L\cdot F\cdot\sin\theta_2$$

wherein $K_2$ is an experimentally adapted rigidity constant for the boom 1.

Thus, the total correction becomes:

for $$\Delta\Phi_2,\ \Delta\Phi_2=\Delta\Phi_{21}+\Delta\Phi_{22}$$

and for $$\Delta\theta_2,\ \Delta\theta_2=\Delta\theta_{21}+\Delta\theta_{22}$$

In a preferred embodiment of the invention a simplified mathematical model of the geometry and rigidity of the drill boom 1 and drill support 2 has been realized in accordance with the considerations described above, as follows:

$$\Delta\Phi_1=K_1\cdot L\cdot F\cdot(\sin\Phi_2\cdot\cos\alpha+\sin\theta_2\cdot\sin\alpha)$$

$$\Delta\theta_1=K_1\cdot L\cdot F\cdot(\sin\theta_2\cdot\cos\alpha+\sin\Phi_2\cdot\sin\alpha)$$

$$\Delta\Phi_2=K_3\cdot F\cdot\cos\beta+K_2\cdot L\cdot F\cdot\sin\Phi_2$$

$$\Delta\theta_2=K_3\cdot F\cdot\sin\beta+K_2\cdot L\cdot F\cdot\sin\theta_2$$

The drill boom 1 is often shaped such that the angles $\alpha$ and $\beta$ equal zero, whereby the simplified mathematical model from about can be simplified still further.

Briefly, the method of the invention comprises the following steps:

The drill stem is adjusted to a correct position and direction in an unloaded condition.

after such adjustment the boom lengths and articulation angles are registered in the unloaded condition.

Then the various boom lengths and articulation angles, which are required to compensate for the deformations which the drill boom and drill support will undergo when loaded at full feeding power, are determined on the basis of the lengths and angles registered as above.

The adjusted boom lengths and articulation angles are corrected when full feeding power is applied, to the lengths and angles having been determined, whereby the drill stem gets a correct position and direction in the loaded position as well.

The mathematical model according to the invention may be realized physically in the form of one or more microprocessors or other more simple electronic devices 16 which are encompassed by the control unit 15. The fixed values in the mathematical model, such as the formulas for the angle-changes, may be deposited into the components in accordance with known technology. The variable values may be deposited as well in the form of series of eligible values, or they may be programmed in the computer or microprocessor mentioned above.

When using an automatically controlled drill rig it has become apparent that a good procedure for setting of the drill in a start drilling position may reduce the number of events when the drill bit slips sideways during setting, down to below 10 per cent. In the remaining events the drill may be correctly aligned in a simple manner by means of method and means having been described herein.

I claim:

1. A method for maintaining, during a drilling operation, a desired orientation and position of the drill stem and bit of a rock drilling rig of the type including an extensible drill boom mounted at a first end thereof on a supporting member for angular articulation relative thereto, a drill support mounted on a second end of said boom for angular articulation relative thereto and for longitudinal extension with respect thereto, a drilling machine mounted on said drill support for longitudinal movement with respect thereto, said drill stem and bit being attached to said drilling machine and movable therewith, measuring means for determining the extended length of said boom, the extended length of said drill support relative to said boom and the articulation angles of said boom with respect to said supporting member and of said drill support with respect to said boom, servo means for adjusting said extended lengths and said articulation angles, and control means connected to said measuring means and said servo means for regulating the orientation of said drill stem and bit by controlling the operation of said servo means in response to said measuring means, whereby during a drilling operation and the application of feeding power from said drilling machine, a desired orientation of said drill stem and bit is altered due to deformation of said drill support and of said boom, said method comprising:

locating said drill stem and bit at said desired orientation and position in an unloaded condition without the application of feeding power;

measuring by said measuring means values of said extended lengths and said articulation angles at said unloaded condition;

determining by said control means corrected values of respective said articulation angles required to compensate for deformation of said drill support and said boom upon the application of a given feeding power from said drilling machine; and upon the application of said given feeding power, operating said servo means by said control means to adjust said articulation angles to said corrected values.

2. A method as claimed in claim 1, wherein said drill support is pivotable with respect to said boom through respective said articulation angles about first and second axes which extend orthogonally to each other, and deformation of said drill support is compensated by adjusting said articulation angles about said first and second axes until the longitudinal direction of said drill stem and bit is the same as if said drill support were not deformed.

3. A method as claimed in claim 1, wherein said boom is pivotable with respect to said supporting member through respective said articulation angles about a first pair of orthogonal axes, said drill support is pivotable with respect to said boom through respective said articulation angles about a second pair of orthogonal axes, and deformation of said boom is compensated by adjusting said articulation angles about said first pair of axes until said second pair of axes are located in space at the same positions as before said boom was deformed, and by adjusting said articulation angles about said second pair of axes until the direction of said drill support is the same as before said boom was deformed.

4. In a rock drilling rig of the type including an extensible drill boom mounted at a first end thereof on a supporting member for angular articulation relative thereto, a drill support mounted on a second end of said boom for angular articulation relative thereto and for longitudinal extension with respect thereto, a drilling machine mounted on said drill support for longitudinal movement with respect thereto, a drill stem and bit attached to said drilling machine and movable therewith, measuring means for determining the extended length of said boom, the extended length of said drill support relative to said boom and the articulation angles of said boom with respect to said supporting member and of said drill support with respect to said boom, servo means for adjusting said extended lengths and said articulation angles, and control means connected to said measuring means and said servo means for regulating the orientation of said drill stem and bit by controlling the operation of said servo means in response to said measuring means, the improvement of means for compensating for alteration of a desired orientation of said drill stem and bit due to deformation of said drill support and said boom during a drilling operation and the application of feeding power from said drilling machine, and thereby for maintaining said desired orientation of said drill stem and bit during a drilling operation, said compensating means comprising means included in said control means for:

at the beginning of a drilling operation, operating said servo means to locate said drill stem and bit at said desired orientation and a desired location in an unloaded condition without the application of feeding power;

operating said measuring means to measure values of said extended lengths and said articulation angles at said unloaded condition;

determining corrected values of respective said articulation angles required to compensate for deformation of said drill support and said boom upon the application of a given feeding power from said drilling machine; and upon the application of said given feeding power during a drilling operation, operating said servo means to adjust said articulation angles to said corrected values.

5. The improvement claimed in claim 4, wherein said compensating means comprises a computer having a mathematical model defining changes of said articulation angles.

* * * * *